US005914461A

United States Patent [19]

Brandt

[11] Patent Number: 5,914,461

[45] Date of Patent: Jun. 22, 1999

[54] CHILD PROOF GUARD FOR A PERSONAL COMPUTER

[76] Inventor: Thomas Michael Brandt, 9035 N. Arroya Vista Dr., Phoenix, Ariz. 85028

[21] Appl. No.: 08/948,813

[22] Filed: Oct. 9, 1997

[51] Int. Cl.[6] ..... H01B 3/42; E05B 1/06

[52] U.S. Cl. ..... 174/135; 70/58; D14/114

[58] Field of Search ..... 174/135, 186, 174/66, 67; 206/308.3, 521, 1.5; D14/114; 74/566; 70/14, 50

[56] References Cited

U.S. PATENT DOCUMENTS 4,898,009 2/1990 Lakowski et al. ..... 70/58
5,052,199 10/1991 Derman ..... 70/58
5,085,395 2/1992 Frater et al. ..... 248/552
5,116,261 5/1992 Lan et al. ..... 312/292
5,305,621 4/1994 Broadwater ..... 70/14

*Primary Examiner*—Kristine Kincaid
*Assistant Examiner*—Mark Olds

[57] ABSTRACT

A device for making a personal computer child proof is disclosed. The device includes two mirror image adhesive-backed mounting plates and one guard. One mounting plate is adhered to one side of the personal computer case. The second mounting plate is adhered to the opposite side of the personal computer case. The guard is fed through both mounting plates and snapped into the deployed position. To disable the guard, the adult need only unhook the guard and feed it clear from both mounting plates.

4 Claims, 5 Drawing Sheets

CHILD PROOF GUARD FOR A PERSONAL COMPUTER

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to personal computers, specifically a device to protect a personal computer from children.

2. Description of the Related Art

To date, it is believed that there has not been a child proof mechanism for a personal computer made or conceived that is within the parameters of the instant invention. Heretofore, when a personal computer was within a child's reach, there was no device to protect the personal computer from the child's unintended mischief. No personal computer guard exists to prevent inadvertent computer shutdown or unintended destruction to some other device, including but not limited to the floppy disk drives, the CD-ROM drive, the tape drive, the floppy disk, the compact disc, or the tape.

There have been several different types of protective devices for personal computers. Derman (U.S. Pat. No. : 5,052,199) discloses an adjustable U-shaped locking bracket for a personal computer with an additional bracket to block disk drive access. Lakoski et al. (U.S. Pat. No. : 4,989,009) discloses a PC protective cover that has slots for ventilation and is pivotally mounted on one side and locked via a key on the other side to provide both security and ease of access. Broadwater (U.S. Pat. No. : 5,305,621) discloses a computer diskette drive lockout device that relies on the "locking disk" and keyed lock to provide ease of access and security. Lan et al. (U.S. Pat. No. : 5,116,261) discloses a locking panel that restricts access to the entire front of the computer. The panel has a separate locking window to allow access to the disk drives and slots for ventilation. Further, Frater et al. (U.S. Pat. No. : 5,085,395) discloses the use of a three piece restraining system consisting of two parallel side bars and a cross member pivotally mounted therebetween.

While the protective devices aforementioned may be satisfactory for some applications, none teaches the use of a slot and tab configuration, to provide for ease of installation, ease of removal, and width adjustment as with the present invention.

BRIEF SUMMARY OF THE INVENTION

In accordance with the present invention, a device for making a personal computer child resistant comprises two adhesive-backed mounting plates, each being comprised of a flat body with one slot and one tab, and a single guard, comprised of a flat body with slots at each end for attachment to both mounting plates and with an optional adhesive-backed brace near its center.

Accordingly, the prominent objects and advantages of this invention are: the personal computer is made child proof, the elegant, adjustable design of the invention will accommodate various sized, shaped, and configured personal computers, and the invention is not expensive to make.

Additional objects and advantages are the device is easy-to-install and easy-to-use by the adult and cannot be mastered by a young child.

Still further objects and advantages will become apparent from a consideration of the ensuing description and accompanying drawings.

DETAILED DESCRIPTION OF THE INVENTION

Figure 1:
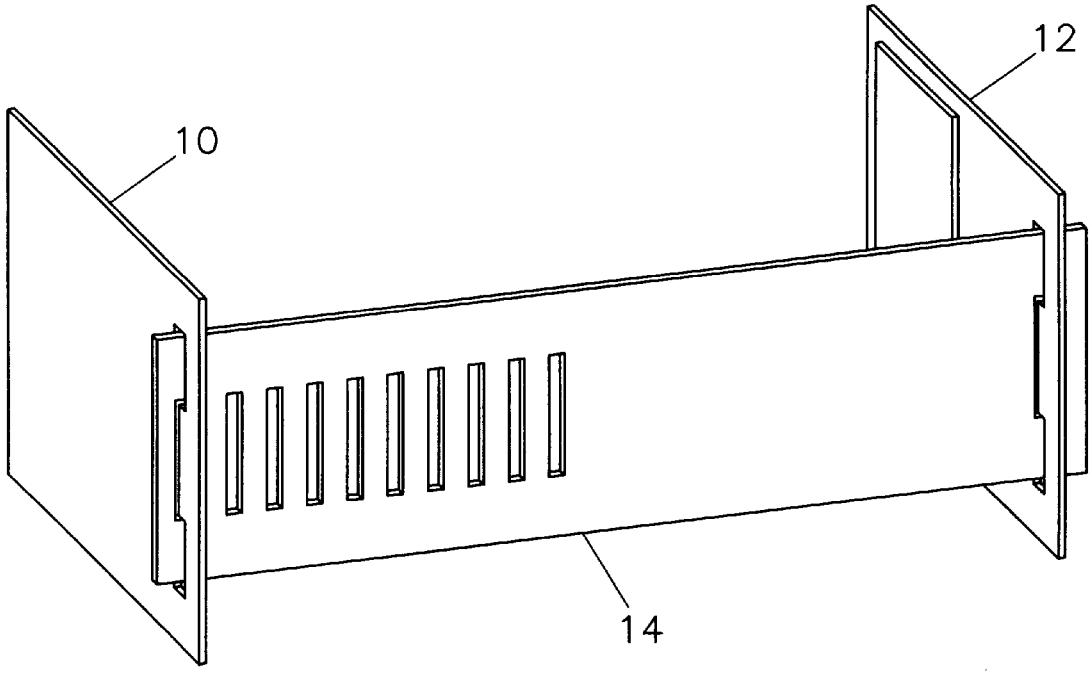
FIG. 1 is a pictorial front view of the component child proof guard for a personal computer according to the invention.

The preferred embodiment of the child proof guard for a personal computer according to the invention is illustrated in FIG. 1. Two mirror image mounting plates 10 and 12 are shown. FIG. 1 shows a guard 14 attached to the two mounting plates. In the preferred embodiment, the guard and the mounting plates are constructed out of flexible plastic. However, the guard and the mounting plates can consist of any other material that can be repeatedly bent without fracturing such as, but not limited to, vinyl, nylon, rubber, various impregnated or laminated fibrous materials, various plasticized materials, etc. The guard and the mounting plates can be fabricated by a punch press or from a mold.

Figure 2:
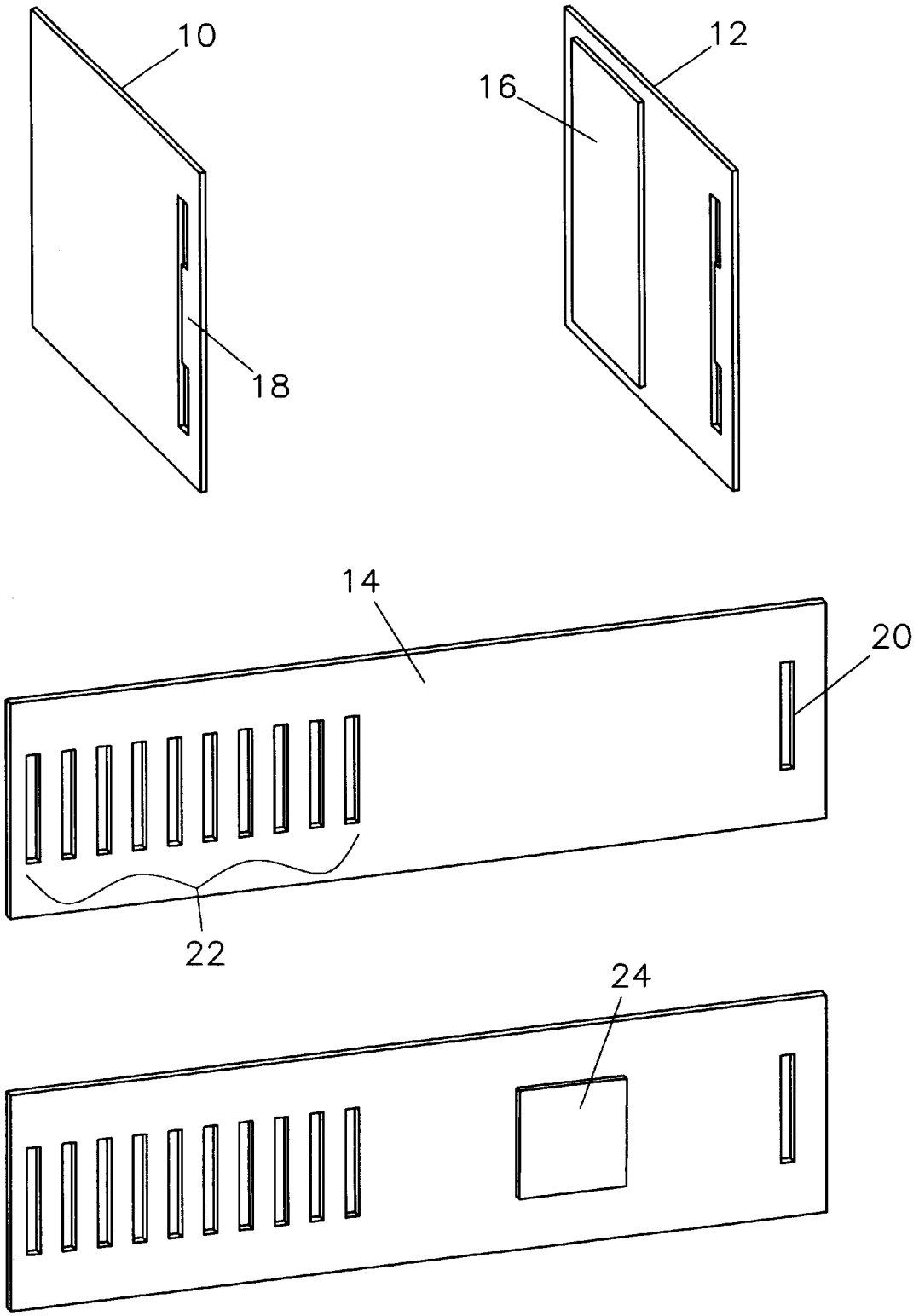
FIG. 2 is a diagram detailing each component part of the child proof guard for a personal computer according to the invention.

FIG. 2 is a diagram detailing each component part of the child proof guard for a personal computer according to the invention. It depicts the details of the invention's main embodiment. As shown in FIG. 2, each mounting plate 10 or 12 is rectangular in shape. FIG. 2 shows mounting adhesive 16 on the interior of the mounting plate. FIG. 2 shows a slot with a tab 18 at the front of the mounting plate, visible from both the interior and exterior perspectives. FIG. 2 also depicts the guard 14. The guard is rectangular in shape. At one end of the guard, there is a single slot 20. At the other end of the guard, there is a set of slots 22. The exact number of these slots is variable and should be large enough to cover the widest anticipated personal computer width. On the interior of the guard, there is an optional adhesive-backed brace 24.

Figure 3:
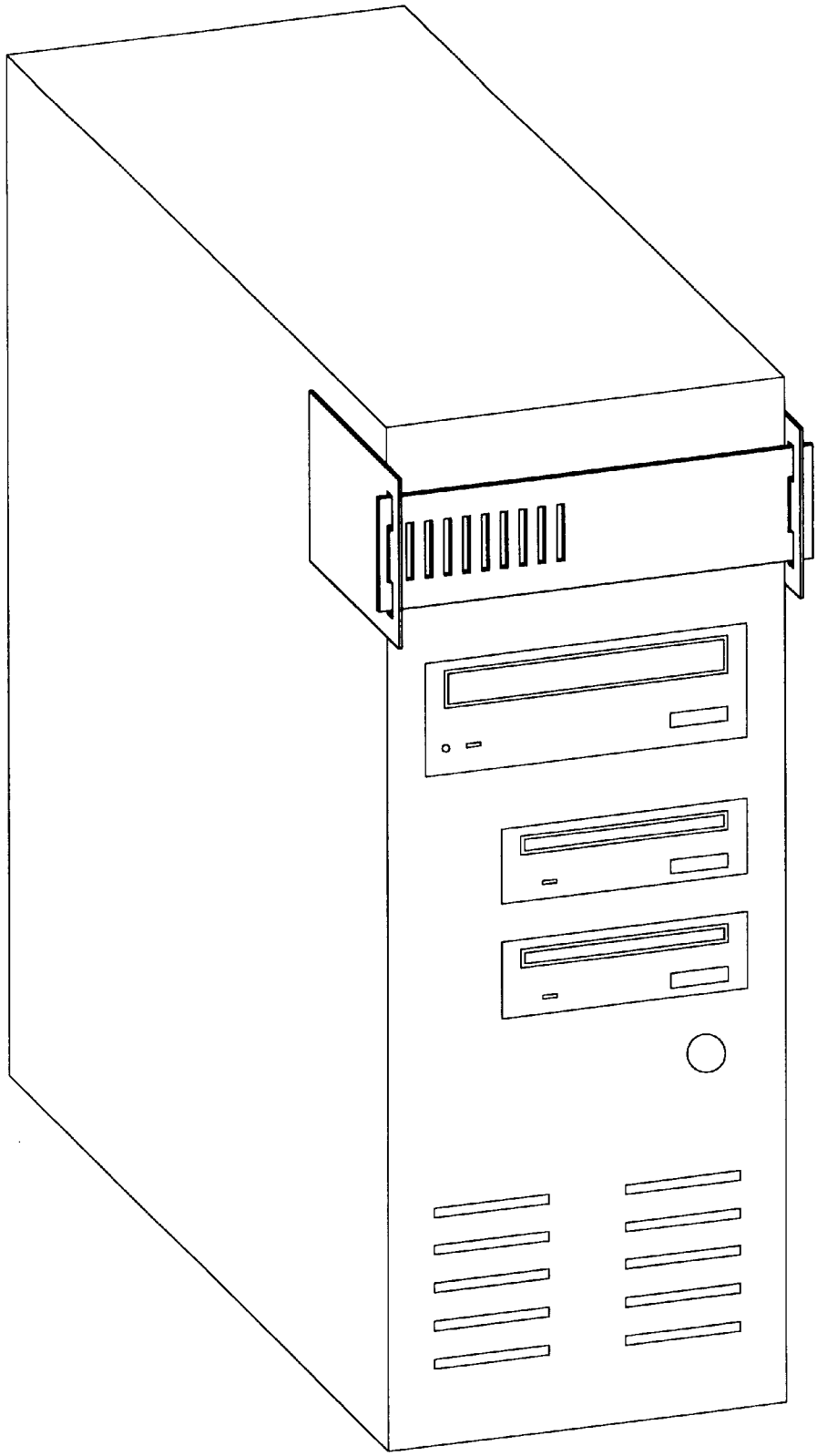
FIG. 3 is an overall perspective view of the child proof guard for a personal computer according to the invention where the personal computer has a tower configuration and the invention is deployed.

FIG. 3 is an overall perspective view of the child proof guard for a personal computer according to the invention where the personal computer has a tower (vertical) orientation and the invention is deployed. With this configuration, the guard is snapped into place and is fully functional.

Figure 4:
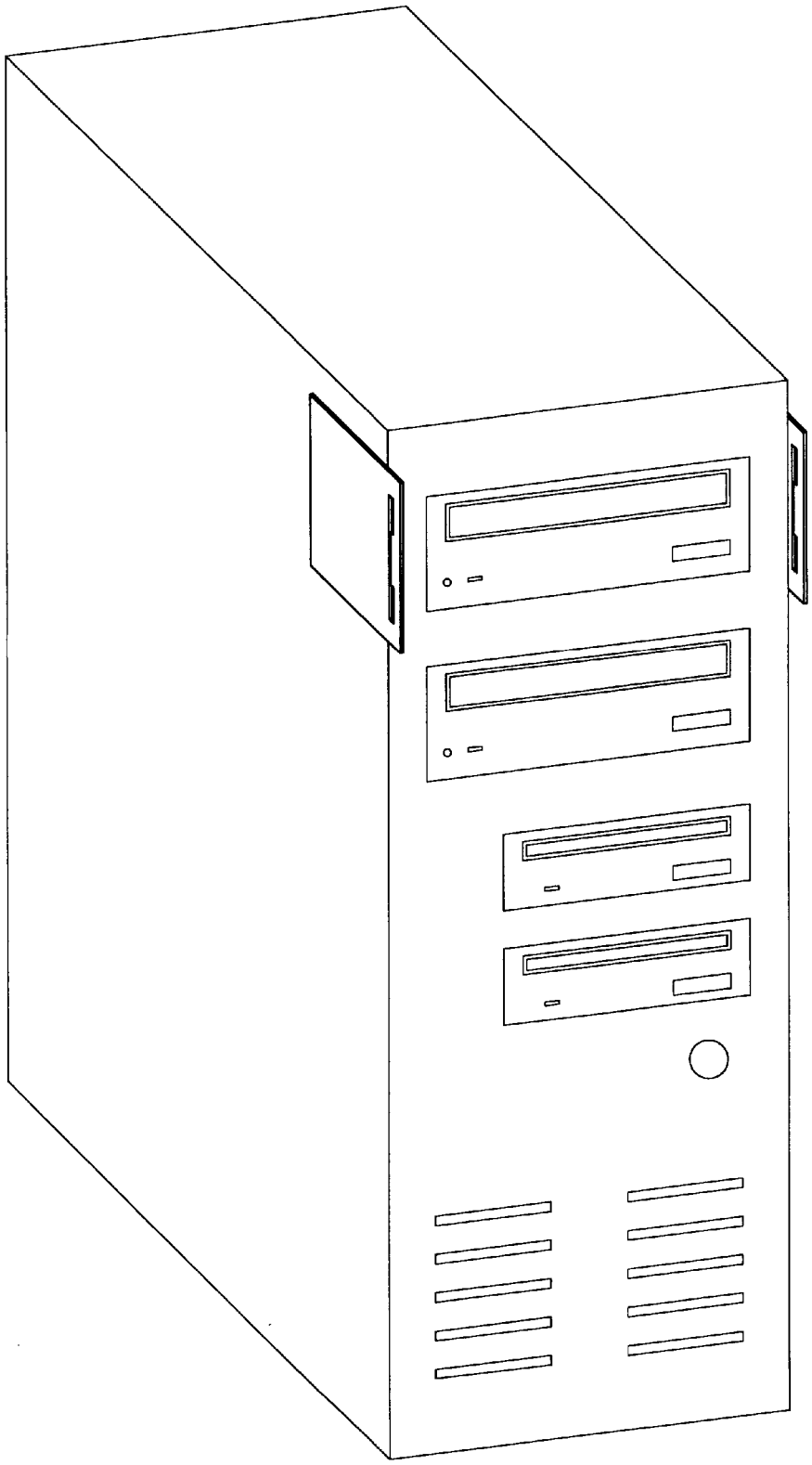
FIG. 4 is an overall perspective view of the child proof guard for a personal computer according to the invention where the personal computer has a tower configuration and the invention is not in use.

FIG. 4 is an overall perspective view of the child proof guard for a personal computer according to the invention where the personal computer has a tower configuration and the invention is not in use. With this configuration, the guard has been removed and the mounting plates remain. Thus, this configuration allows for power on/off of the computer and/or normal operation of other computer devices (i.e., insertion/ejection of disks from the disk drives, insertion/ejection of compact discs from the CD ROM drives, etc.) depending on the chosen deployed location of the invention.

Figure 5:
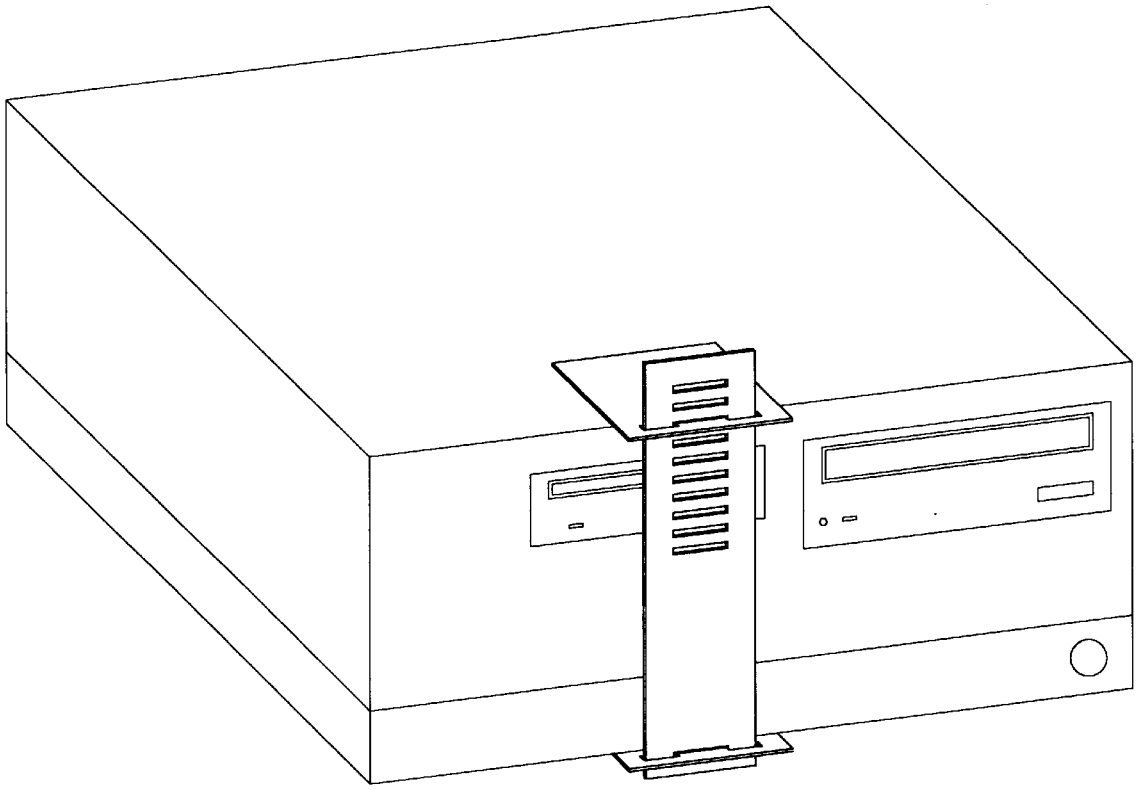
FIG. 5 is an overall perspective view of the child proof guard for a personal computer according to the invention where the personal computer has a desktop configuration and the invention is deployed.

FIG. 5 is another perspective view of the child proof guard for a personal computer according to the invention where the personal computer has a desktop (horizontal) orientation and the invention is deployed. The guard slots are snapped onto the mounting plate tabs and thus, enabled.

In operation and for purposes of illustration, mounting adhesive is referenced, not by way of limitation as other methods of attachment are readily obvious for attaching the mounting plates to the personal computer such as, but not limited to, VELCRO (hook and loop fasteners), and the like.

Operation and use of the child proof guard for a personal computer is simple and straightforward.

1. Assuming the personal computer has a tower orientation (FIG. 3), one of tile mounting plates is adhered on one side of the tower case, near the top of the case and in line with the computer device to be protected (i.e., the power switch or the floppy disk drive). The mounting plate is mounted so that slot is freestanding, protruding beyond the edge of the personal computer.
2. The other mounting plate is adhered to the other side of the tower in the same fashion as described above and in line with the first mounting plate.
3. If there is a protruding device(s) (i.e., power switch, reset button, etc.) on the face of the personal computer, the optional adhesive-backed brace is adhered to the interior of the guard.
4. Holding the guard with the single slot end to the right and the adjustable slot end to the left, the guard's single slot end is fed first through the leftmost mounting plate slot and then through the rightmost mounting plate slot. The guard's single slot is then snapped onto the tab of the slot of the rightmost mounting plate. With the single slot end of the guard secured, the appropriate slot at the adjustable end of the guard, given the width of the tower, becomes evident. The appropriate adjustable guard slot is then snapped onto the tab of leftmost mounting plate. The excess guard length may be clipped with scissors. This deployed configuration is depicted in FIG. 1, FIG. 3, and FIG. 5. With this configuration, the child proof guard is activated and the computer device is protected.
5. To disable the invention, the adult must only unlock the guard by unhooking the guard from both mounting plate tabs and then sliding the guard clear from both mounting plates. This disabled configuration is depicted in FIG. 4.

Accordingly, it can be seen that, according to the invention, a child proof guard for a personal computer is provided which makes the personal computer child resistant, accommodates various sized, shaped, and configured personal computers, is not expensive to fabricate, is reliable, easy to install, and easy to use.

Although the description above contains many specificities, these should not be construed as limiting the scope of the invention but as merely providing illustrations of some of the presently preferred embodiments of this invention. Various other embodiments and ramifications are possible within it's scope. For example, the slots in the guard can be other shapes, such as circular, oval, triangular, etc., the tabs in the mounting plates can be other shapes, such as circular, triangular, etc.

Thus, the scope of the invention should be determined by the appended claims and their legal equivalents, and not by the examples given.

I claim:

1. A device for making a personal computer child resistant, comprising:

(a) two mounting plates, each said plate being comprised of a flat body of material, each said plate having an interior and an exterior side, each said plate with a slot near one end thereof, each said plate with a tab in said slot, and each said plate with an adhesive means on said interior side of each mounting plate, (b) one guard, comprised of a flat body of material, having an interior and an exterior side, With a single slot near one end thereof for attachment to one of the two said mounting plates, with a series of slots at the opposite end thereof, one of the slots in said series of slots acting as a means for attachment to the second of the two said mounting plates, and with an optional adhesive-backed brace on the interior side of the guard to provide clearance beyond any protruding device on the front of the personal computer.

2. The device for claim 1 wherein said body of material is composed of plastic.

3. The device for claim 1 wherein each said mounting plate is from 4 square to 16 square inches in area and from 1/32 to 1/4 inch thick.

4. The device for claim 1 wherein said guard is 1/32 to 1/8 inch thick and 1 to 4 inches wide and 8 to 20 inches long.

* * * * *